US007162981B2

(12) United States Patent
Hernandez

(10) Patent No.: US 7,162,981 B2
(45) Date of Patent: Jan. 16, 2007

(54) SYSTEM FOR ANNULUS TOOLING ALIGNMENT WITH SUCTION PICKUP IN THE STAY DOME ON THE SECONDARY SIDE OF A STEAM GENERATOR

(75) Inventor: Eric Leon Hernandez, Lynchburg, VA (US)

(73) Assignee: Framatome Anp, Inc., Lynchburg, VA (US)

( * ) Notice: Subject to any disclaimer, the term of this patent is extended or adjusted under 35 U.S.C. 154(b) by 0 days.

(21) Appl. No.: 11/082,067

(22) Filed: Mar. 16, 2005

(65) Prior Publication Data

US 2006/0207525 A1 Sep. 21, 2006

(51) Int. Cl.
*F22B 37/48* (2006.01)

(52) U.S. Cl. ..... 122/379; 122/392; 122/405; 376/316; 134/167 R

(58) Field of Classification Search ..... 122/379, 122/390, 392, 396, 405; 376/245, 249, 310, 376/316; 134/167 R, 181
See application file for complete search history.

(56) References Cited

U.S. PATENT DOCUMENTS 4,374,462 A * 2/1983 Wojcik et al. ..... 451/76
4,445,465 A * 5/1984 Byrd et al. ..... 122/392
4,848,278 A * 7/1989 Theiss ..... 122/383
5,813,370 A * 9/1998 Owen et al. ..... 122/382
5,913,320 A * 6/1999 Varrin et al. ..... 134/22.18
6,820,575 B1 * 11/2004 Ashton et al. ..... 122/379

* cited by examiner

*Primary Examiner*—Gregory A. Wilson
(74) *Attorney, Agent, or Firm*—Vytas R. Matas

(57) ABSTRACT

A system is provided for delivering tooling, suction pickup, and alignment platforms to a stay dome region of a stem generator or the tube-free lane regions adjacent to the stay dome region and includes a suction device positioned in the stay dome region of a steam generator capable of rotating 360° about a vertical axis which also acts as a platform for mounting inter-bundle tooling and alignment devices used to position the suction device radially at any given tube location around the stay dome region to align it with an annulus based spray nozzle tube cleaning system.

2 Claims, 3 Drawing Sheets

SYSTEM FOR ANNULUS TOOLING ALIGNMENT WITH SUCTION PICKUP IN THE STAY DOME ON THE SECONDARY SIDE OF A STEAM GENERATOR

BACKGROUND OF THE INVENTION

1. Field of the Invention

The present invention generally relates to steam generator maintenance tooling such as sludge removal systems and more particularly to such systems for use in the stay dome area on the secondary side of the steam generator.

2. Description of the Prior Art

Buildup of sediment or sludge on the secondary face of the tube sheet in a boiler or steam generator has been proven to contribute to degradation of the tube material. It is a common practice to lance the tube sheet and tube support plates with high pressure water to wash the sludge from between the tubes to a suction pickup where it can be removed from the steam generator. Most re-circulating steam generators have a wide lane that separates the hot leg tubes from the cold leg tubes. A wand that contains high pressure nozzles is usually inserted into this lane and the sludge forced out to the area between the steam generator shell and the tube bundle, called the annulus. From the annulus the sludge is easily washed to a suction pickup and removed from the steam generator.

In some re-circulating steam generators the geometry of the tube bundle does not permit lancing to be efficiently performed from a lane in the tube bundle. These generators must be lanced either totally or partially from the annulus. When lanced from the annulus, suction pickup and alignment of the annulus-based device with the suction pickup must be done from the wide tube-free lane that separates the hot leg tubes from the cold leg tubes. Additionally, some steam generators contain a circular cutout of tubes in the center of the tube bundle. The center of this tube cutout may contain a spherical dome, known as a stay dome, which must be negotiated by tooling in order to provide suction pickup and deliver alignment platforms allowing annulus lancing to be most effective.

BRIEF SUMMARY OF THE INVENTION

The present invention provides a system for delivering tooling, suction pickup, and an alignment platform to the stay dome region of a steam generator as well as the tube-free lane regions adjacent to the stay dome region. The system is positioned in the tube-free lane or in the stay dome region and is capable of delivering suction pickup, alignment platforms, and tooling for inspection, retrieval and repair around the entire stay dome region. The system includes a suction device positioned in the stay dome region of a steam generator capable of rotating 360° about a vertical axis. This suction device is operated from a remote location outside the steam generator and provides suction pickup and also serves as a platform for mounting inter-bundle tooling and alignment devices. The device is capable of performing all its functions simultaneously or individually as required. The alignment devices can be used to position the device radially at any given tube location around the stay dome region or to align it with an annulus-based spray nozzle tube cleaning system. The alignment devices include lights and cameras which sense the annulus based cleaning system for aligning the sludge pushed from the tube lanes with the stay dome based suction device.

In view of the foregoing it will be seen that one aspect of the present invention is to provide a device for delivering various types of tooling in the stay dome area of a steam generator for inspection, cleaning alignment and repair purposes.

Another aspect is to provide a stay dome located device capable of 360° rotation about a vertical axis to provide a platform for suction pickup from an annulus based cleaning system.

Still yet another aspect is to provide a stay dome located cleaning device having an on board camera and lights for aligning the annulus based cleaning system with the suction pickup device located on the stay dome.

These and other aspects of the present invention will be more fully understood after a review of the following description of the preferred embodiment when considered along with the accompanying drawings.

DESCRIPTION OF THE PREFERRED EMBODIMENT

The locomotion and tooling system of the present invention is designed to simplify maintenance and sludge removal from the secondary side of a steam generator.

Figure 1:
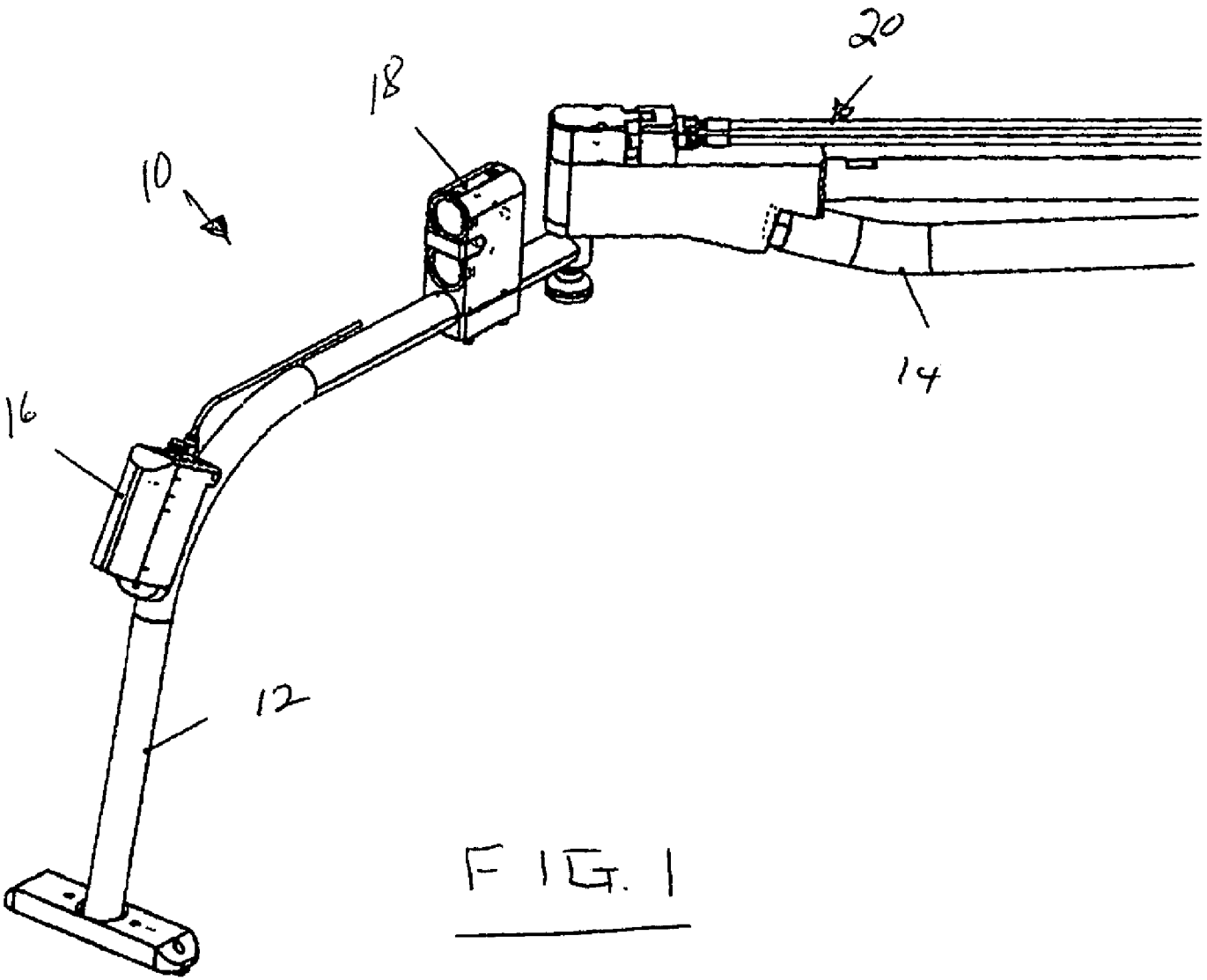
FIG. 1 is an isometric perspective view of the stay dome suction assembly of the present invention.
Figure 3:
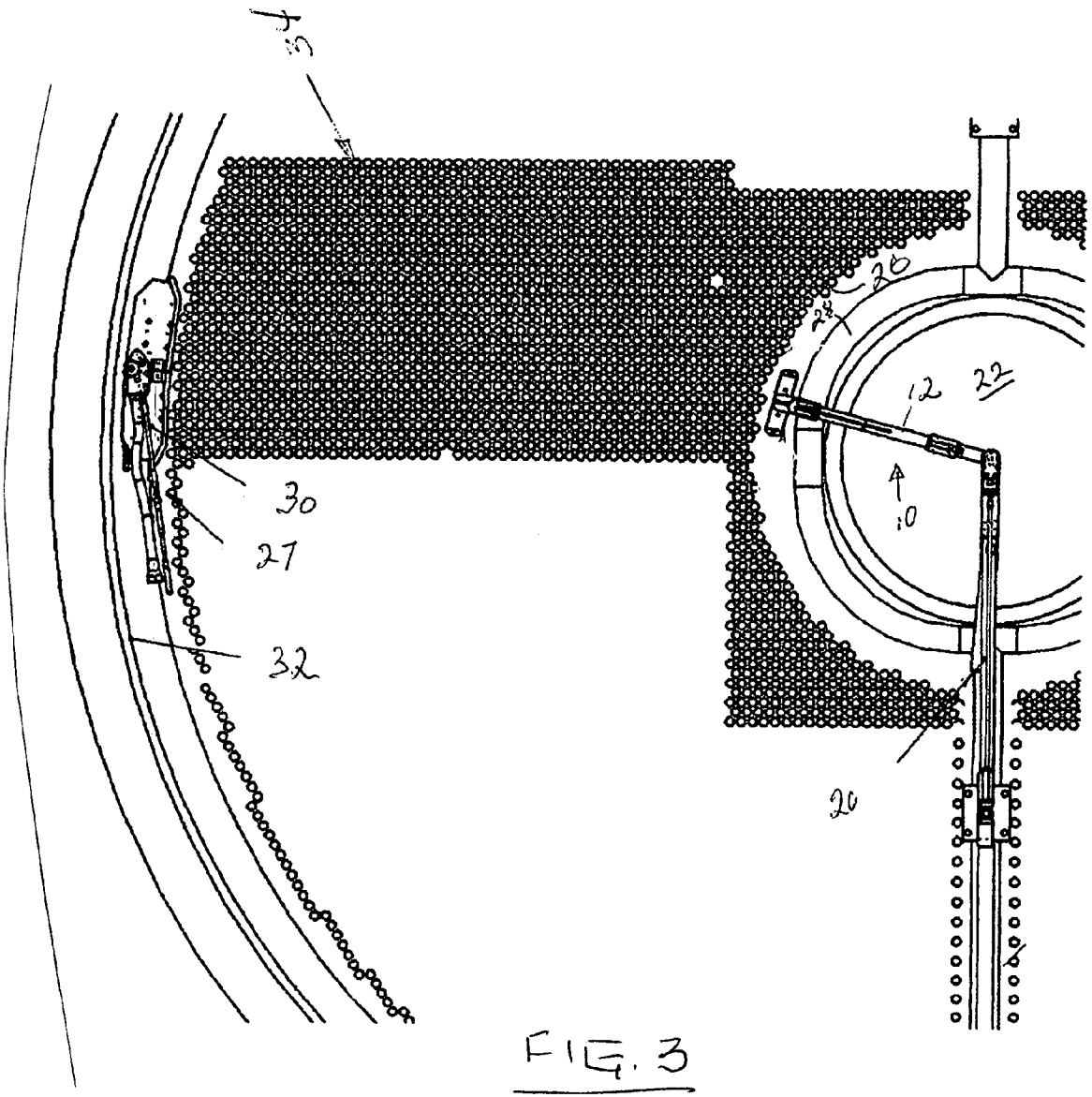
FIG. 3 shows a view of the annulus tooling aligned with the suction device in the steam generator shown in FIG. 2.

Referring now to FIG. 1 a stay dome suction assembly (10) is shown having a suction pickup (12) leg connected to a hose (14) leading outside the steam generator for removing the sludge picked up by the suction leg (12), A positioning camera (16) and alignment light (18) is mounted on the leg (12) to facilitate the alignment of the suction leg (12) with a cleaning device (30) located in the annulus (32) of the steam generator as seen in FIG. 3. The assembly (10) also includes a rotating pulley and cable assembly (20) for rotating the suction leg (12) 360° around the stay dome.

Figure 2:
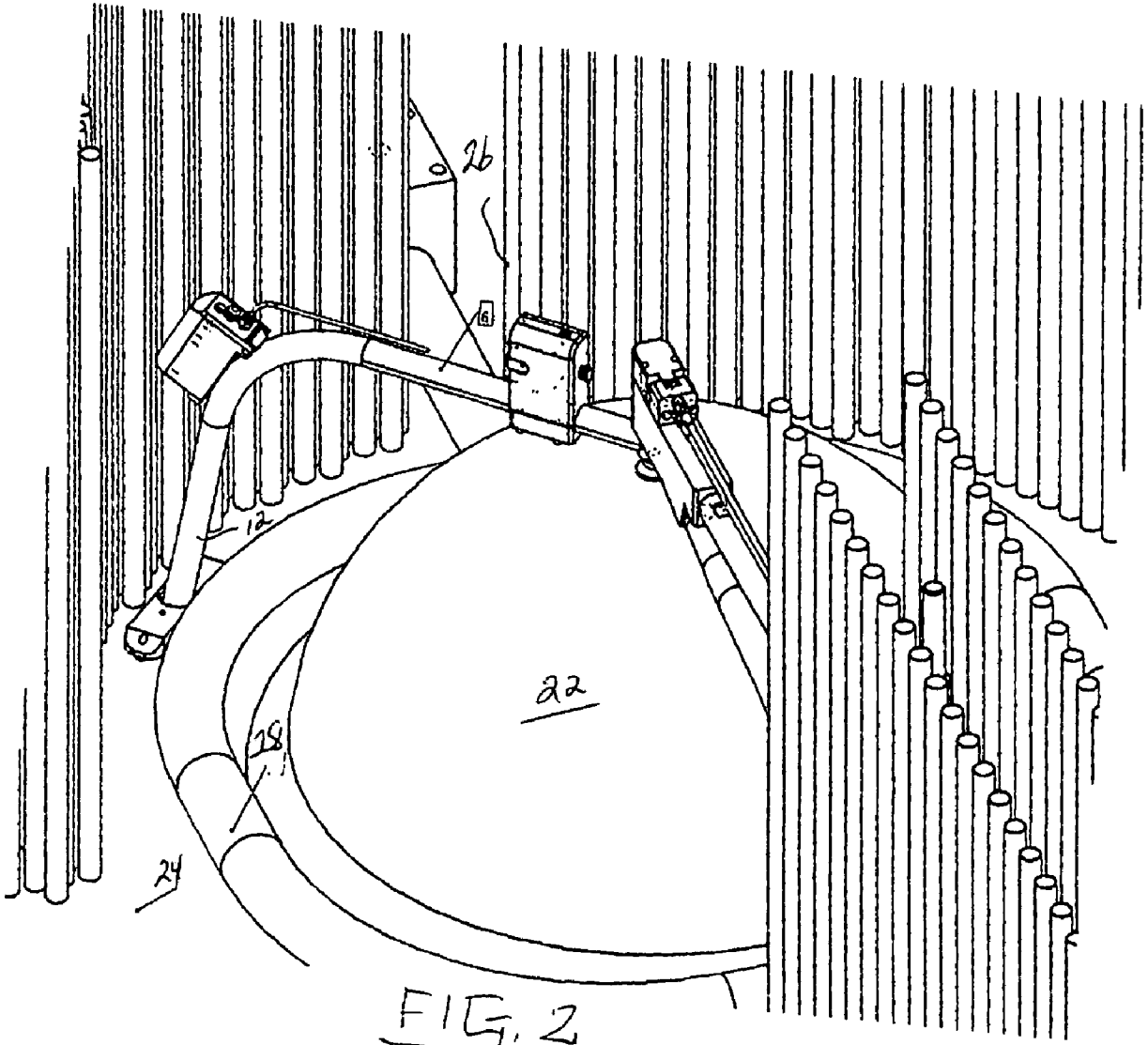
FIG. 2 is an isometric view of the stay dome assembly of FIG. 1 mounted within the steam generator.

Referring now to FIG. 2 a top view of the stay dome suction assembly (10) is shown as it is mounted on the stay dome (22) of the steam generator. The assembly (10) is shown sitting on top of the stay dome (22) with the suction pickup (12) resting on tube sheet (24) between the steam generator tubes (26) and a blow down pipe (28).

The stay dome (22) is located in the center of the steam generator. The steam generators (or heat exchanger) are entities attached to the reactor via piping. The reactor heats the water. The water moves through the piping to the steam generator. The reactor water, or primary water, heats the secondary water inside the steam generator. Heat is added to the secondary water until it turns to steam. The steam moves to the turbines and produce electricity. The present invention is used inside the steam generator. The assembly (10) rests on top of the stay dome (22) which provides structural support for the steam generator.

FIG. 3 shows a top view to the steam generator with an annulus-based tool (30) located between the steam generator shell (32) and the outermost tubes (34) of the tube bundle. The device (30) is a cleaning device having a series of high pressure water nozzles which are insertable into the tube lanes and are rotatable 180 degrees around a horizontal axis to clean the sludge from the tubes and push it to the area (24) next to the stay dome (22). This device is described in detail in a co-pending patent application entitled "SYSTEM FOR CLEANING, INSPECTION AND TOOLING DELIVERY IN THE SECONDARY SIDE OF A STEAM GENERATOR" and the reader is referred thereto for a more detailed explanation. The stay dome suction assembly (10) is installed atop the stay dome (22) with its suction pickup (12) positioned at the innermost tubes (20) surrounding the stay dome (22) and works best to pick up the sludge when it is in line with the annulus-based tool (30) pushing the sludge toward the stay dome area. For clarity, not all steam generator tubes are shown.

The proper positioning of the suction device (12) in the stay dome region in line with the cleaning device (30) allows for suction pickup at the source of sludge laden water exiting the tube bundle at the tubes surrounding the stay dome region. Additionally, the device (12) can accurately deliver tooling and position alignment devices at specified locations with all tasks being performed from a remote location.

The assembly (10) may be rotated using a motor, cable and pulley, torque transmitting cable, or rigid pole. Encoder or resolver feedback (not shown) is used to monitor the assembly (10) position. The assembly (10) may rest on the stay cylinder if present or directly on the tubesheet (24). The assembly (10) may also be positioned in the tube-free lane (34) adjacent to the stay dome (22) region.

The alignment light (16) works as follows: Principles of physics dictate that for large openings, light can be assumed to be non-bending. As such, by illuminating the center of the tube bundle in the stay dome region the annulus based cleaning device (30) can be aligned perpendicular to a tube lane. The geometry of the tube bundle within a steam generator is such that there are lanes between the adjacent tubes. When a periphery device is aligned to the illumination at the center of the bundle, then it has to be aligned to that particular tube lane. If the periphery device is equipped with a camera, or photocell, etc, then simply if the camera (or photocell, etc) "sees" light then the tooling or water jet has to be in line with the tube lane.

If the periphery-based platform is a foreign object retrieval system for example, then obviously the suction pickup function of this stay dome based tool is not used. In this example, the stay dome tool's alignment feature would probably not be utilized.

Certain obvious details and modifications have been deleted herein for the sake of conciseness and readability but are properly within the scope of the following claims.

I claim:

1. A method of removing sludge located in the area of a steam generator stay dome generated by spraying the tube lanes with high pressure water nozzles from an annulus of the steam generator comprising the steps of:

providing a suction device in the area of the stay dome or cut out region and aligning it with a device in the annulus used for cleaning the tube lane;

actuating both the suction device and the cleaning device to push sludge toward the stay dome area only when the suction device is aligned with the cleaning device;

rotating the suction device to the next tube lane and aligning it with the cleaning device; and actuating both the suction device and the cleaning device.

2. A method as set forth in claim 1 including the steps of rotating the suction device 360 degrees around the stay dome to pick up all the sludge pushed into the stay dome area by the cleaning device.

* * * * *